United States Patent [19]

Gomez

[11] 4,241,966

[45] Dec. 30, 1980

[54] CONNECTOR WITH EJECTOR-RETAINER MEANS

[75] Inventor: José J. Gomez, Los Angeles, Calif.

[73] Assignee: Thomas & Betts Corporation, Raritan, N.J.

[21] Appl. No.: 33,755

[22] Filed: Apr. 26, 1979

[51] Int. Cl.[3] ..... H01R 13/62

[52] U.S. Cl. ..... 339/45 M; 339/75 M

[58] Field of Search ..... 339/45 R, 45 M, 45 T, 339/75 R, 75 M, 75 MP

[56] References Cited

U.S. PATENT DOCUMENTS

| | | | |
|---|---|---|---|
| 3,150,906 | 9/1964 | Chambon et al. | 339/45 M |
| 3,601,746 | 8/1971 | Teagno | 339/75 MP |
| 3,609,547 | 9/1971 | Slusser | 339/45 M |
| 3,993,390 | 11/1976 | Eigenbrode | 339/91 R |
| 4,006,957 | 2/1977 | Narozny | 339/103 M |
| 4,057,879 | 11/1977 | Eigenbrode | 339/91 R |
| 4,070,081 | 1/1978 | Takahashi | 339/91 R |
| 4,076,204 | 2/1978 | Kalka | 339/91 R |
| 4,089,579 | 5/1978 | Steinbach | 339/91 R |
| 4,105,275 | 8/1978 | Dixon et al. | 339/91 R |
| 4,152,038 | 5/1979 | Inouye et al. | 339/75 M |
| 4,178,051 | 12/1979 | Kocher et al. | 339/45 M |

FOREIGN PATENT DOCUMENTS

| | | | |
|---|---|---|---|
| 2812631 | 10/1978 | Fed. Rep. of Germany | 339/45 M |
| 28892 | 3/1978 | Japan | 339/45 M |
| 729296 | 5/1955 | United Kingdom | 339/75 M |

*Primary Examiner*—Neil Abrams

*Attorney, Agent, or Firm*—James J. Daley; Robert M. Rodrick; Jesse Woldman

[57] ABSTRACT

The improvement to a header which provides a selectively installable, selectively rotatable lever having thereon provisions to eject a connector placed on such header when rotated in a first direction by an operator gripping an extension of such lever, mating a connector to such header when the lever means is rotated in a second direction and positioning restraining means at one or more selective positions with respect to a connector to retain same in mating relationship with said header. The header is provided with suitable recesses to accept tabs on the lever to allow for selective lever rotation and slots to permit the selective installation and removal of the lever with respect to the header.

3 Claims, 10 Drawing Figures

CONNECTOR WITH EJECTOR-RETAINER MEANS

BACKGROUND OF THE INVENTION

1. Field of the Invention:

The invention is directed to the field of interconnecting flat cable to a printed circuit board where a connector is connected to the flat cable and a mating header is bonded to the printed circuit board and more particularly to devices for assisting the mating of such connectors with such headers and the retention and ejection of such connectors.

2. Description of the Prior Art

Prior art devices such as exemplified in U.S. Pat. Nos. 3,993,390; 4,057,879; 4,076,204 and 4,105,275 provide means for retaining a connector of a fixed height in a header. No provision is made for retaining connectors of different heights in the same header nor is there any provision for a device to assist in the mating of the connector with the header, a task of some difficulty when the header pins are oversized, the connector sockets are tight or where the physical area available to cause engagement is restricted. Finally, no provision is made to eject the connector from the header when a disconnect is desired. The user merely pulls on the cable, possibly disengaging the cable from the connector, bending pins on the header or otherwise injuring the joint and impairing further matings of connector and header.

SUMMARY OF THE INVENTION

The present invention overcomes the shortcomings and deficiencies of prior art devices by providing a selectively installable selectively rotatable lever having an upturned toe-like projection at one end arranged to be brought into contact with the bottom surface of a connector and upon continued rotation of said lever in a first direction to cause the separation of such connector from the header with which it is mated. Said lever having a projection to bear against a portion of a connector to assist in mating the connector with its associated header when said lever is rotated in a second direction. Finally, at least two projections are provided on the lever to accommodate connectors of different heights and to retainingly engage the connectors when the lever is rotated in the second direction.

Recesses are placed in the side walls of the header to receive projecting tabs of the lever and permit rotation thereof. Entry recesses leading to the first recesses allow the lever to be selectively inserted or removed. Finally, a recess is provided to receive the ejector toe when same is in the withdrawn position. It is an object of this invention to provide an improved retaining means for a header.

It is a further object of this invention to provide a retaining means for a header capable of engaging connectors of different sizes.

It is another object of this invention to provide an ejector means for a header.

It is still another object of this invention to provide a combined means for selectively retaining a connector in a header or ejecting such connector therefrom.

It is another object of this invention to provide a combined means for selectively retaining connectors of different heights in a header or ejecting such connector therefrom.

It is yet another object of this invention to provide an inserter for connectors to be mated with a header.

It is still another object of this invention to provide a combined means having an inserter for mating a connector with a header and a retention means for retaining such connector in mating relationship with such header.

It is still another object of this invention to provide a combined means having an inserter for mating a connector with a header and multiple retention means for retaining connectors of different heights in mating relationship with such header.

It is yet another object of this invention to provide a combined means having an inserter for mating a connector with a header, multiple retention means for retaining connectors of different heights in mating relationship with such header and ejector means for separating said connector from said header.

Other objects and features of the invention will be pointed out in the following description and claims and illustrated in the accompanying drawings, which disclose, by way of example, the principle of the invention, and the best mode contemplated for carrying it out.

BRIEF DESCRIPTION OF THE DRAWINGS

In the drawings in which similar elements are given similar reference characters.

Figure 1:
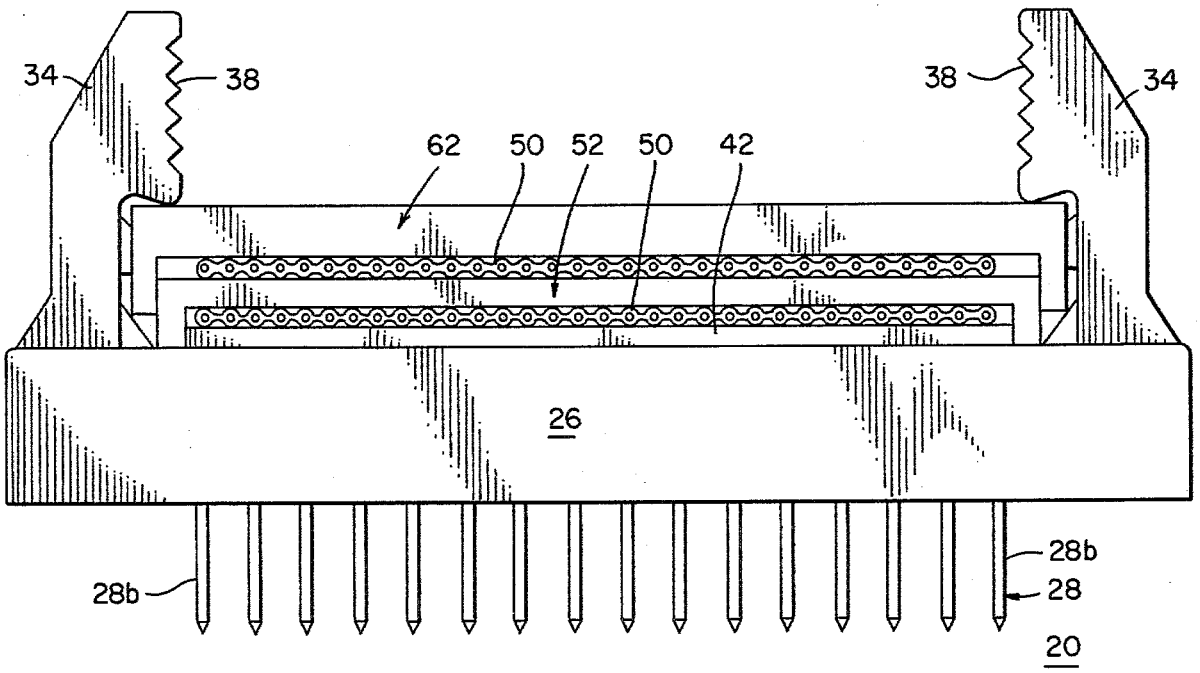
FIG. 1 is a side elevation of a header with connector installed and showing ejector-retainer means constructed in accordance with the concept of the invention.
Figure 2:
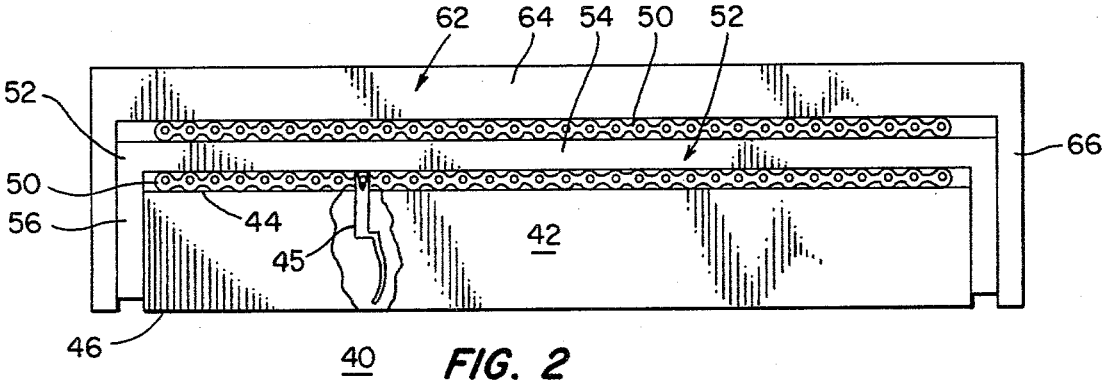
FIG. 2 is a side elevation of a typical connector used with the header of the invention, cut away to show a conductor contact.
Figure 4:
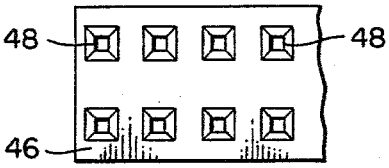
FIG. 4 is a fragmentary bottom plan view of the body of the connector FIG. 2.
Figure 3:
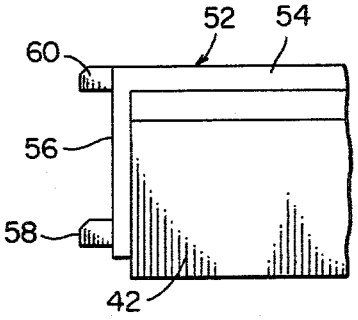
FIG. 3 is a fragmentary side elevation of the connector of FIG. 2 with the strain relief removed to expose certain details of the connector body.
Figure 7:
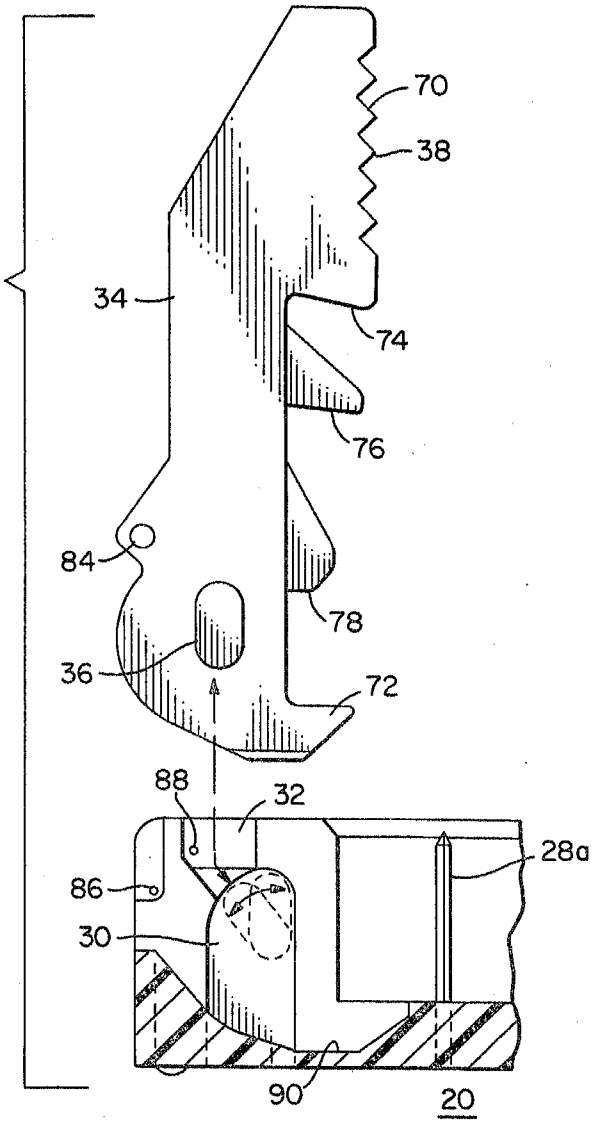
FIG. 7 is a fragmentary, exploded side elevational view, partly cut away and partly in section, of the header and ejector-retainer member separated similar to FIG. 5.
Figure 6:
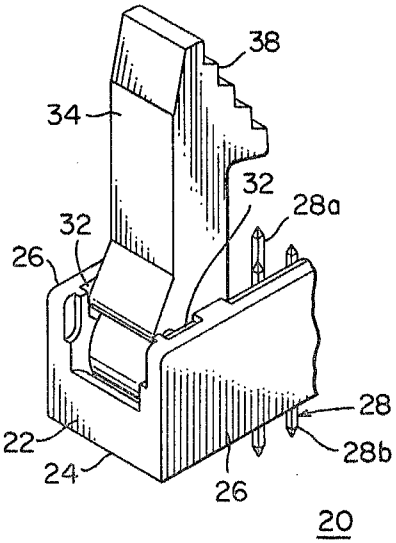
FIG. 6 is a fragmentary perspective view of the header of FIG. 5 with the ejector-retainer member assembled thereto.
Figure 5:
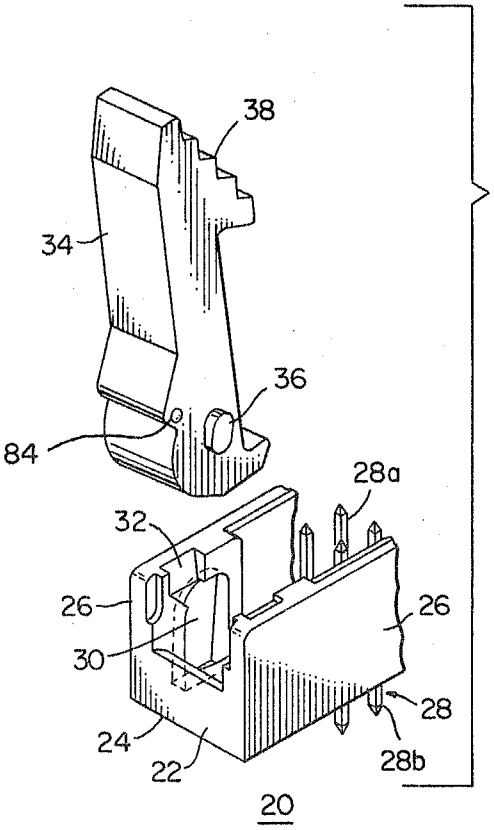
FIG. 5 is a fragmentary, exploded perspective view of the header of the invention with the ejector-retainer member separated therefrom.

DESCRIPTION OF THE PREFERRED EMBODIMENTS:

Turning now to FIGS. 1 to 6, a header 20 constructed in accordance with the concepts of the invention is shown with a connector 40 mated therewith and retained thereby. Connector 40, as is best appreciated from FIG. 2, is composed of a body 42 having a plurality of bores extending therethrough from a top surface 44 to a bottom surface 46. Within the bores are a plurality of electrical contacts 45 which extend to insulation piercing contacts above surface 44 and socket portions adjacent surfaces 46. As is shown in FIG. 4, a plurality of apertures 48 extend into the bottom surface 46 of connector body 42. The apertures 48 permit the entry of header pins into the body 42 and make contact with the socket portions of the contacts within body 42.

To hold multiconductor flat cable 50 in place and joined with the contacts of the connector 40, a cover 52 is placed over the body 42 and the flat cable 50. The cover 52 has a flat base 54 that overlies the flat cable 50 and two downwardly projecting arms 56 that engage knobs 58 on the sides of the body 42 (see FIG. 3) to lock the cover arms 56 in place. A further set of knobs 60 project from the arms 56 of the cover 52. A strain relief 62 extends over the flat cable returned over the cover 52 top and between the flat base 64 of the strain relief 62. Downwardly extending arms 66 engage the knobs 58 and 60 to hold them in their desired place.

The header 20 is made up of a base 24 with upstanding members of side walls 26 and upstanding end member of end wall 22 and a series of pins 28 projecting through such base 24 and extending on both sides of it. Pins **28*a* extend upwardly, enter the apertures 48 and contact the socket portions of the contacts in the body 42 whereas pins 28*b* extend downwardly to enter the plated through apertures of a printed circuit board for example. An ejector-retainer 34 having tabs 36 extending therefrom can enter through slots 32, in the side walls 26, into the recesses 30 in which the tabs 36 are free to rotate as will be described below. A finger grip 38 at one end of the ejector-retainer 34** facilitates rotation thereof.

Turning now to FIGS. 7 to 10, there is shown an ejector-retainer 34 constructed in accordance with the concepts of the invention. The ejector-retainer lever 34 terminates at one end in the finger grip portion 38 having a series of saw-teeth 70 therein to facilitate the gripping and rotation of the ejector-retainer lever 34. At the opposite end of the ejector-retainer lever 34 is an ejector toe 72 which is arranged to get under and apply an upward force to the surface 46 of the connector 40 to thus separate the socket portions from the pins **28*a* of the header 20. The end of the finger grip portion 38 terminates in a downwardly directed surface 74 with a curved leading edge to override the top surface of the strain relief 62 and apply a sufficient force thereto to keep the connector 40 from being removed or loosened upon the pins 28*a* of the header 20 (see FIG. 10). A further downward surface 76 is provided below the surface 74 to engage the top of the cover 52 and knobs 60 when no strain relief 62 is present. This surface also keeps the connector 40 from being removed or loosened upon the pins 28*a* of the header 20 (see FIG. 10**).

Since it is necessary to make all joints at one time, considerable force is required to mate the socket portions of connector 40 with the pins **28*a* of the header 20. To assist an inserter lug 78 is provided which is arranged to bear upon the knobs 58 to force the connector 40 into place on the header 20 (see FIG. 10). It should be noted that inserter lug 78, and inclined surfaces 74, 76 respectively operate when the ejector-retainer lever 34 is rotated in a first direction or clockwise in the direction of the arrow 80 shown in FIG. 10. Conversely, the ejector 72 operates when the ejector-retainer lever 34 is rotated in a second direction or counter-clockwise in the direction of the arrow 82**.

Figure 8:
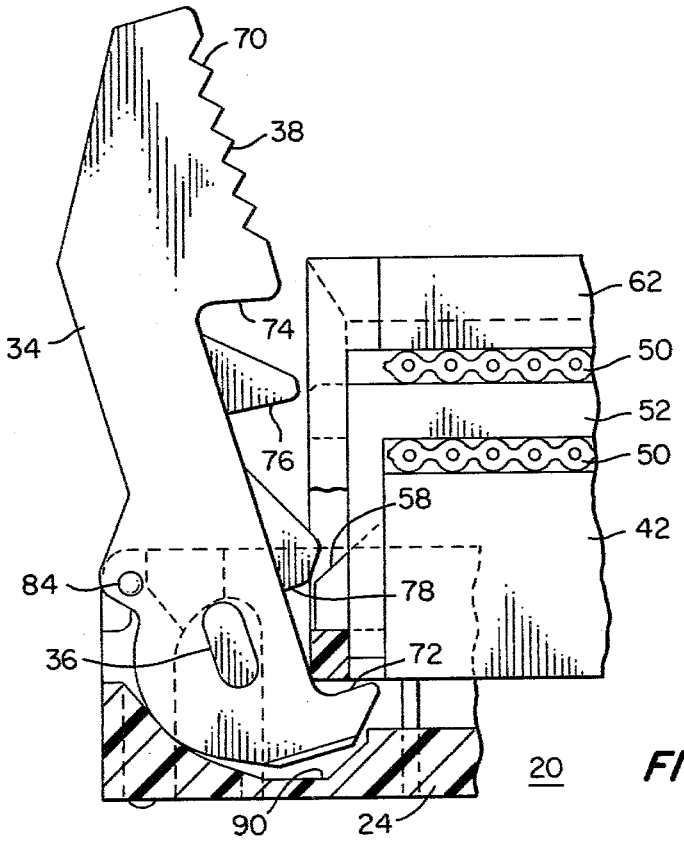
FIG. 8 is a fragmentary side elevational view, partly in section, with the ejector-retainer member shown in the eject position.
Figure 9:
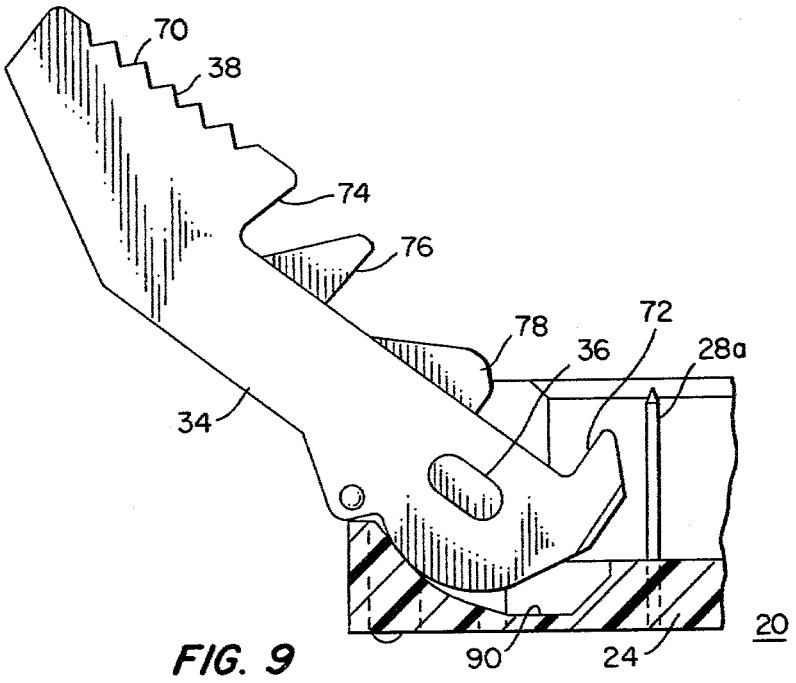
FIG. 9 is a fragmentary side elevational view, partly in section, with the ejector-retainer member in its maximum eject position.

Placed on the ejector-retainer lever 34 is a positioning button 84. Placed upon the walls 26 of the header 20 is an open detent 86 and a closed detent 88. When the positioning button 84 of the ejector-retainer lever 34 is in the open detent 86 the lever 34 is in the open position where the ejection toe 72 has operated to eject the connector 40 and the inserter lug 78 and retainer surfaces 74, 76 are free of contact with the connector, as is best seen in FIG. 8. If the ejector-retainer lever 34 is carried beyond the detent 86 then the ejector-retainer lever 34 will be stopped by the engagement between the lever 24 and the top surface of end wall 28 as is shown in FIG. 9.

Figure 10:
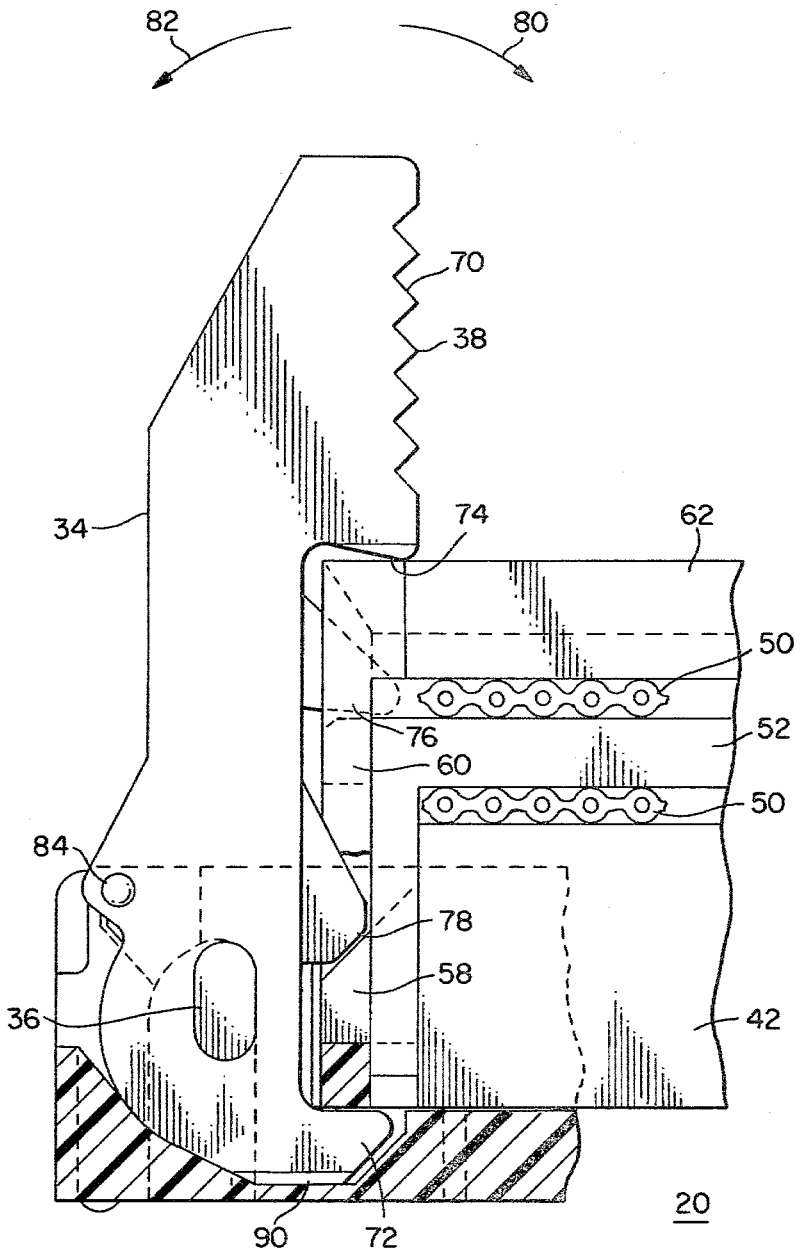
FIG. 10 is a fragmentary side elevation, partly in section, of a connector assembled to the header of the instant invention.

In FIG. 10 the connector 40 is fully assembled within the header 20 and the ejector-retainer lever 34 is in the full closed position with positioning button 84 engaging the closed detent 88 (not visible in figure). The retaining surface 74 is overriding the top of the strain relief 62, the retaining surface 76 is overriding the top of the cover 52 as well as knob 60, the insertion lug 78 is in contact with knob 58 and the ejector toe 78 is fully within the recess 90 in the bottom of base 24. Also the tab 36 is within the recess 30.

If it is desired to remove the ejector-retainer lever 34 it is only necessary to align the tabs 36 with the slots 32. They can be reinserted the same way.

By way of summary of the foregoing, a header for releasably terminating a multiconductor cable connector to a printed circuit board or the like includes base 24 having electrically conductive pins 28 for engaging contacts connected to the cable conductors. Connector body 42 has through passages for contacts and functions as a cable support. Cover 52 overlies body 42 to also engage and retain the cable. Ejector-retainer lever 34 of the header serves as an actuator both for seating the connector and release of such seating, being supported by base 24 for first and second opposite sense movements. In its first sense movement, the lever 34 provides relative displacement of body 42 and base 24 to engage pins 28 with the connector contacts. In its second sense movement, the lever 34 provides relative displacement of body 42 and base 24 to separate pins 28 form the connector contacts. In the illustrated preferred embodiment, lever 34 is a rigid body and is supported by base 24 for pivotal movements of opposite sense, i.e., clockwise and counterclockwise. With this arrangement, the lever 34 defines first surface 78 engaging body 42 on clockwise lever movement and a second surface, provided by toe 72, engaging body 42 on counterclockwise lever movement. Third surface 76 is arranged with first surface 78 oppositely relative to the lever pivot point from the second (toe) surface, whereby surface 76 may overlie cover 52 on completion of clockwise lever movement. A fourth surface 74 is arranged to overlie strain relief 62 when said lever 34 is moved in the clockwise direction.

While there have been shown and described and pointed out the fundamental novel features of the invention as applied to the preferred embodiments, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. Header-connector apparatus for terminating a multiconductor cable, comprising:

(a) a header having a plurality of electrically conductive pin members;

(b) a connector supported by said header and having electrical contacts for engagement individually with conductors of said cable and with said pin members, said connector defining a planar surface in facing relation to said header and having openings for passage of said pin members into said connector;

(c) a cover supported on said connector for retaining said cable therewith; and (d) actuator means supported by said header for first and second respectively opposite sense movements, (1) said actuator means having a first surface engageable with said connector in said first sense movement for affecting engagement of said pin members and said contacts, (2) said actuator means having a second surface fixedly spaced with respect to said first surface and movable through the plane of said connector surface in said second sense movement for affecting separation of said pin members from such engagement with said contacts, and (3) said actuator means having a third surface movable into overlying relation to said cover in said first sense movement.

2. The apparatus claimed in claim 1 wherein said actuator means comprises a rigid member and wherein said header supports said rigid member for pivotal movement, said first and third surfaces being located oppositely with respect to said second surface relative to the pivot point of said rigid member.

3. The apparatus claimed in claim 1 further including strain relief member supported on said cover for retaining said cable therewith, said actuator means having a fourth surface movable into overlying relation to said strain relief member in said first sense movement.

* * * * *